US009086064B2

(12) United States Patent
Aso et al.

(10) Patent No.: US 9,086,064 B2
(45) Date of Patent: Jul. 21, 2015

(54) SOLVENT DELIVERY PUMP

(75) Inventors: Yoshiaki Aso, Kyoto (JP); Kumiko Jingu, Kyoto (JP); Fujio Inoue, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 470 days.

(21) Appl. No.: 13/449,660

(22) Filed: Apr. 18, 2012

(65) Prior Publication Data

US 2012/0288386 A1 Nov. 15, 2012

(30) Foreign Application Priority Data

May 9, 2011 (JP) ..... 2011-104216

(51) Int. Cl.
*F04B 53/14* (2006.01)
*F04B 13/00* (2006.01)
*F04B 53/16* (2006.01)

(52) U.S. Cl.
CPC ..... *F04B 53/143* (2013.01); *F04B 13/00* (2013.01); *F04B 53/162* (2013.01)

(58) Field of Classification Search
CPC ..... F04B 53/02; F04B 53/18; F04B 53/162; F04B 53/143; F16J 15/32
USPC ..... 92/168; 277/500, 584
See application file for complete search history.

(56) References Cited

U.S. PATENT DOCUMENTS

| | | | | |
|---|---|---|---|---|
| 5,492,053 | A * | 2/1996 | Stonehill | 92/241 |
| 5,890,415 | A * | 4/1999 | Asou | 92/128 |
| 6,213,000 | B1 | 4/2001 | Wood | |

FOREIGN PATENT DOCUMENTS

| | | | |
|---|---|---|---|
| CN | 2409352 | Y | 12/2000 |
| JP | 60-502224 | A | 12/1985 |
| JP | 11-159474 | A | 6/1999 |
| JP | 2001-254686 | A | 9/2001 |
| JP | 2008-180088 | A | 8/2008 |
| JP | 2008-255805 | A | 10/2008 |
| JP | 4477391 | B2 | 6/2010 |
| WO | 85/01336 | A1 | 3/1985 |

OTHER PUBLICATIONS

Japanese Office Action dated Feb. 18, 2014, issued in corresponding Japanese Patent Application No. 2011-104216, w/English translation. (4 pages).

(Continued)

*Primary Examiner* — Nathaniel Wiehe
*Assistant Examiner* — Abiy Teka
(74) *Attorney, Agent, or Firm* — Westerman, Hattori, Daniels & Adrian, LLP

(57) ABSTRACT

A plunger seal has a cylindrical protruding portion on its front face. A base end portion of the protruding portion has a recessed curved shape having a certain curvature. In a portion of a pump head, where the plunger seal is mounted, a seal insertion portion into which the protruding portion of the plunger seal is to be fitted is formed as a cylindrical recessed portion. An opening edge portion of the seal insertion portion has a protruding curved shape having the same curvature as the base end portion of the protruding portion of the plunger seal.

4 Claims, 5 Drawing Sheets

(56) References Cited

OTHER PUBLICATIONS

Chinese Office Action dated Jun. 4, 2014, issued in corresponding Chinese Patent Application No. 201210116286.0, w/English translation (7 pages).

Japanese Office Action dated Oct. 7, 2014, issued in corresponding application No. 2011-104216, with English translation. (4 pages).

* cited by examiner

SOLVENT DELIVERY PUMP

BACKGROUND OF THE INVENTION

1. Field of the Invention

The present invention relates to a solvent delivery pump for delivering a solvent by sliding a plunger in a pump head to repeat suctioning of the solvent from a suctioning port and discharge of the solvent from a discharge port.

2. Description of the Related Art

A general plunger-type solvent delivery pump will be described with reference to FIG. 2A.

A pump head 18 is mounted to a tip end of a pump body 2 with a cleaning chamber 12 interposed therebetween. A pump chamber 18*a* is provided in the pump head 18 and a plunger 3 is inserted into the pump chamber 18*a*. A base end portion of the plunger 3 is retained by a crosshead 4 housed in the pump body 2.

The crosshead 4 is driven for reciprocation in one direction (a left-right direction in the drawing) by a cam mechanism (not shown) and a tip end portion of the plunger 3 slides on a straight line in the pump chamber 18*a* in the pump head 18 as the crosshead 4 is driven for reciprocation. If the tip end portion of the plunger 3 slides on the straight line in the pump chamber 18*a*, a solvent is suctioned into the pump chamber 18*a* from a suctioning port 18*b* and is discharged from a discharge port 18*c* continuously to deliver the solvent.

To a portion of the pump chamber 18*a* where the plunger 3 is inserted, a plunger seal 20 for preventing leakage of the solvent from a clearance between an inner wall of the pump chamber 18*a* and an outer periphery of the plunger 3 is mounted. The plunger seal 20 is a ring-shaped member made of resin having a through hole in its central portion and retains, for sliding, the plunger 3 inserted through the through hole at the portion of the pump chamber 18*a* where the plunger 3 is inserted. In this manner, it is common practice in the plunger-type solvent delivery pump to mount the resin seal member to the portion of the pump chamber where the plunger is inserted (see Japanese Unexamined Patent Publication No. 2001-254686, for example).

The portion where the plunger seal 20 is mounted is shown in FIG. 2B. The plunger seal 20 has a cylindrical protruding portion 20*a* on its face (front face) on the pump chamber 18*a* side and the protruding portion 20*a* is fitted into a seal insertion portion 18*d* formed as a recessed portion in a face of the pump head 18 on the pump body 2 side. A backup ring 11 is disposed on a face (back face) of the plunger seal 20 on the pump body 2 side and biased toward the pump head 18 by a wall face of the cleaning chamber 12, and, as a result, a flange-shaped peripheral edge portion 20*c* of the plunger seal 20 is sandwiched between the pump head 18 and the backup ring 11.

In the example in FIG. 2B, the protruding portion 20*a* of the plunger seal 20 has an open groove 20*b* open on a front side so as to increase forces of the plunger seal 20 for retaining the plunger 3 and coming in close contact with a wall face of the pump head 18 by utilizing pressure from the pump chamber 18*a*, which improves sealing performance. The open groove 20*b* is a ring-shaped cavity surrounding the plunger 3 in a circumferential direction.

In the above solvent delivery pump, the flange-shaped peripheral edge portion 20*c* of the plunger seal 20 is sandwiched between the pump head 18 and the backup ring 11 and, therefore, it is necessary to provide a structure for allowing stress applied from the backup ring 11 on the plunger seal 20 to escape. Therefore, in some conventional cases, as in the example in FIG. 2B, an opening edge portion 18*f* of the seal insertion portion 18*d* of the pump head 18 is tapered and a base end portion 20*d* of the protruding portion 20*a* of the plunger seal 20 corresponding to the opening edge portion 18*f* is formed in a tapered shape corresponding to the tapered shape of the opening edge portion 18*f*. The tapered shape of the base end portion 20*d* of the protruding portion 20*a* is formed by a smaller face than the tapered shape of the opening edge portion 18*f* so as to form a clearance between the faces of both the tapered shapes for allowing the plunger seal 20 to be deformed due to the stress.

With this structure, however, edge portions of the tapered shape constantly come in contact with a surface of the plunger seal 20, the stress for fixing the plunger seal 20 is concentrated on these portions, and these portions are more likely to deteriorate than other portions. If the plunger seal 20 deteriorates and the performance for sealing the portion of the pump chamber 18*a* where the plunger 3 is inserted reduces, the solvent leaks from the pump chamber 18*a* to the pump body 2 side, and it is impossible to deliver the solvent with high accuracy.

SUMMARY OF THE INVENTION

It is an object of the present invention to provide a solvent delivery pump in which a plunger seal is less likely to deteriorate.

A solvent delivery pump according to the present invention includes: a pump body; a pump head mounted to a tip end portion of the pump body including a solvent inlet for suctioning a solvent, a pump chamber for storing the solvent suctioned from the solvent inlet, and a solvent outlet for discharging the solvent in the pump chamber; a plunger passing through the tip end portion of the pump body having a tip end inserted into the pump chamber to slide in the pump chamber; a seal insertion portion formed in a face of the pump head on the pump body side as a cylindrical recessed portion having a larger inner diameter than an outside shape of the plunger and communicating with the pump chamber; and a ring-shaped plunger seal having, on its face on the pump head side, a cylindrical protruding portion to be fitted into the seal insertion portion retaining the plunger for sliding between the pump body and the pump head to thereby seal a portion of the pump chamber where the plunger is inserted, wherein an opening edge portion of the seal insertion portion of the pump head has a section having a protruding curved shape, a base end portion of the protruding portion of the plunger seal has a recessed curved shape corresponding to the opening edge portion of the seal insertion portion, and the opening edge portion and the base end portion of the protruding portion are in contact with each other.

Both the curved shapes of the opening edge portion of the seal insertion portion and the base end portion of the protruding portion are preferably arc shapes. In this way, stress applied on the plunger seal is distributed the most uniformly and longevity of the plunger seal can be further extended.

In the solvent delivery pump according to the present invention, the opening edge portion of the seal insertion portion of the pump head has the protruding curved shape, the base end portion of the protruding portion of the plunger seal has the recessed curved shape corresponding to the opening edge portion of the seal insertion portion, and the opening edge portion and the base end portion of the protruding portion are in contact with each other. Therefore, the stress is not concentrated on a particular portion of a surface of the plunger seal, and it is possible to slow the progress of deterioration of the plunger seal.

BRIEF DESCRIPTION OF THE DRAWINGS

FIGS. 1A and 1B are drawings showing an embodiment of a solvent delivery pump, wherein FIG. 1A is a sectional view of a portion of a pump body on a tip end side and FIG. 1B is an enlarged sectional view of part of FIG. 1A around a pump chamber;

FIGS. 2A and 2B are drawings showing an embodiment of a conventional solvent delivery pump, wherein FIG. 2A is a sectional view of a portion of a pump body on a tip end side and FIG. 2B is an enlarged sectional view of part of FIG. 2A around a pump chamber; and FIGS. 3A and 3B are drawings showing results of simulations of stressed portions of sections of plunger seals, wherein FIG. 3A shows the result in the conventional structure and FIG. 3B shows the result in the structure in the embodiment in FIGS. 1A and 1B.

DETAILED DESCRIPTION OF THE INVENTION

Figure 1A:
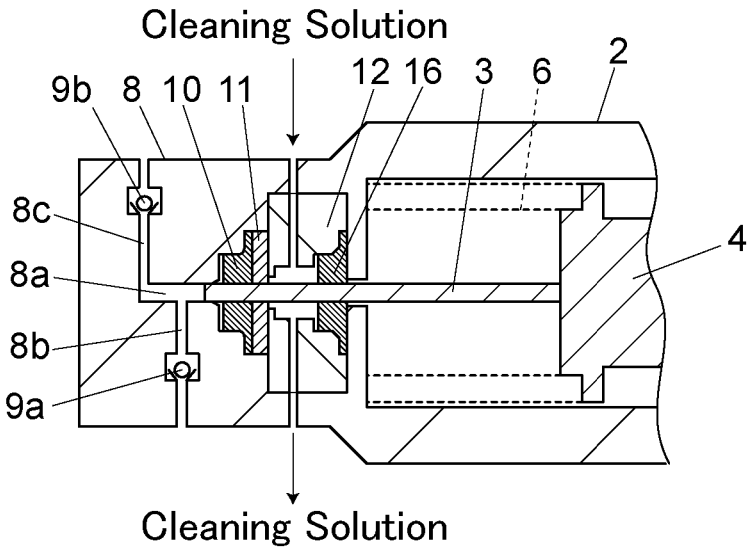

A structure of an embodiment of a solvent delivery pump will be described with reference to FIG. 1A.

In the solvent delivery pump of the embodiment, a pump head 8 is mounted to a tip end of a pump body 2 with a cleaning chamber 12 interposed therebetween. In the pump body 2, a crosshead 4 is housed to be movable. The crosshead 4 is constantly pushed by an elastic body 6 such as a spring in such a direction as to move away from the pump head 8 (rightward in the drawing) and follows a peripheral face of a cam (not shown) provided on a side of a base end portion of the crosshead 4. By following the peripheral face of the rotating cam, the crosshead 4 reciprocates in such directions as to approach and move away from the pump head 8 in the pump body 2 (left-right directions in the drawing).

A base end portion of the plunger 3 is retained by a tip end of the crosshead 4. A tip end portion of the plunger 3 passes through the cleaning chamber 12 and is inserted into a pump chamber 8*a* provided in the pump head 8. The tip end portion of the plunger 3 slides along a wall face of the pump chamber 8*a* when the crosshead 4 reciprocates. The pump head 8 includes a solvent inlet flow path 8*b* for taking a solvent into the pump chamber 8*a* and a solvent outlet flow path 8*c* for pushing the solvent out of the pump chamber 8*a*. In the solvent inlet flow path 8*b* and the solvent outlet flow path 8*c*, check valves 9*a* and 9*b* for preventing back-flows are provided, respectively.

A plunger seal 10 is mounted to a portion of the pump chamber 8*a* of the pump head 8 where the plunger 3 is inserted. Details of the plunger seal 10 and the portion where the plunger seal 10 is mounted will be specifically described later. The plunger seal has a cylindrical protruding portion to be fitted into a seal insertion portion formed as a recessed portion in a face of the pump head 8 on the pump body 2 side, retains the plunger 3 for sliding between the pump body 2 and the pump head 8, and seals a portion of the pump chamber 8*a* where the plunger is inserted. An opening edge portion of the seal insertion portion of the pump head 8 has a section having a protruding curved shape, a base end portion of the protruding portion of the plunger seal 10 has a recessed curved shape corresponding to the opening edge portion of the seal insertion portion, and the opening edge portion and the base end portion of the protruding portion are in contact with each other.

A backup ring 11 is inserted on a pump body 2 side of the plunger seal 10. The backup ring 11 is biased toward the pump head 8 by a wall face of the cleaning chamber 12 and, as a result, a flange-shaped peripheral edge portion of the plunger seal 10 is sandwiched between the pump head 8 and the backup ring 11.

The cleaning chamber 12 has, inside itself, flow paths through which a cleaning solution flows and a space for cleaning an outer peripheral face of the plunger 3, passing through the cleaning chamber 12, with the cleaning solution. At a portion of the inner space of the cleaning chamber 12 where the plunger 3 is inserted, a cleaning seal 16 for retaining the outer peripheral face of the plunger 3 for sliding is provided in order to prevent leakage of the cleaning solution. A back face of the cleaning seal 16 is supported by a wall face of the pump body 2.

In this solvent delivery pump, by driving the plunger 3 in such a direction so as to move away from the pump chamber 8*a* (rightward in the drawing), pressure in the pump chamber 8*a* is reduced, the check valve 9*b* is closed, the check valve 9*a* is opened, and the solvent is suctioned into the pump chamber 8*a* from the solvent inlet flow path 8*b*. On the other hand, by driving the plunger 3 in such a direction so as to be inserted into the pump chamber 8*a* (leftward in the drawing), an inside of the pump chamber 8*a* is pressurized, the check valve 9*a* is closed, the check valve 9*b* is opened, and the solvent is pushed out of the pump chamber 8*a* into the solvent outlet flow path 8*c*. By repeating these operations, the solvent is delivered.

Figure 1B:
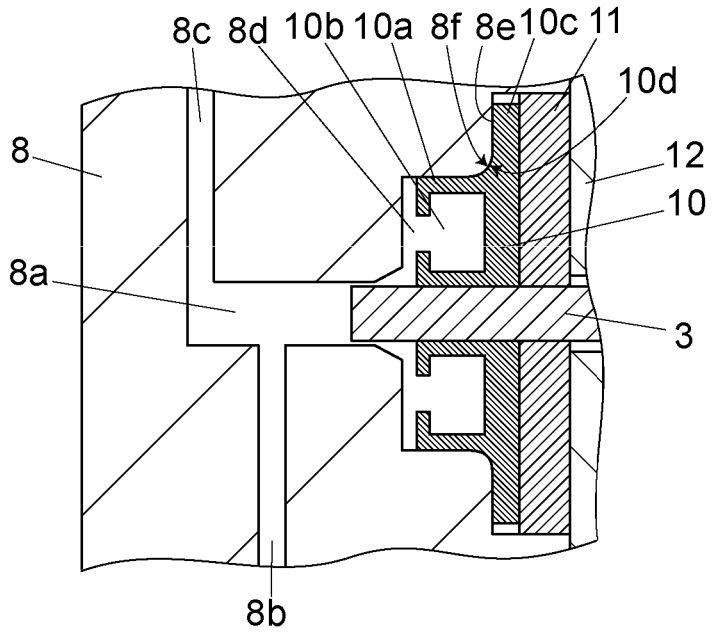
Figure 1C:
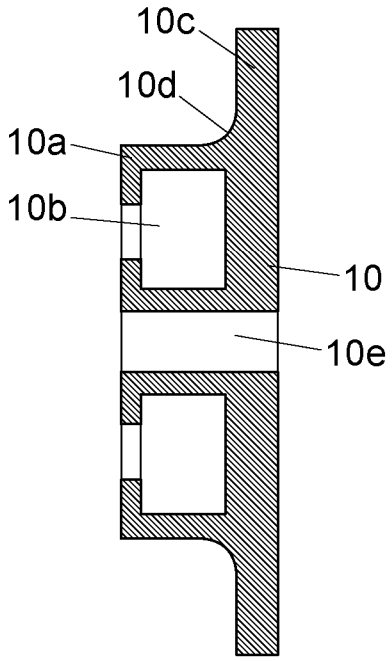
FIG. 1C is an enlarged sectional view of plunger seal 10;.
Figure 2A:
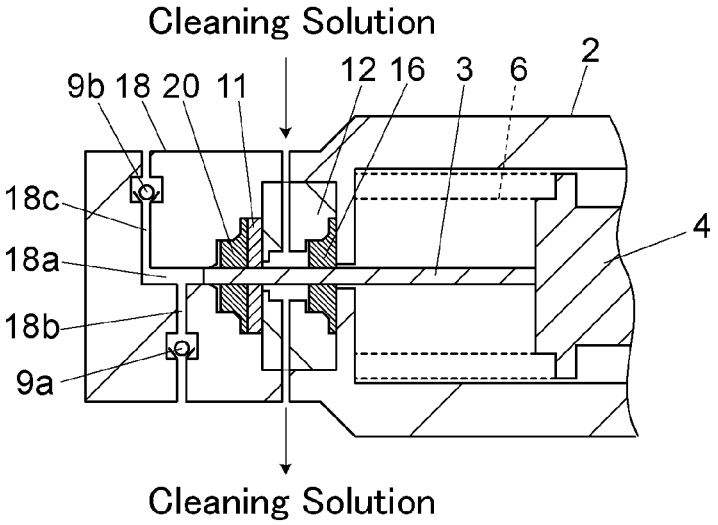
Fig. 2A Prior Art
Figure 2B:
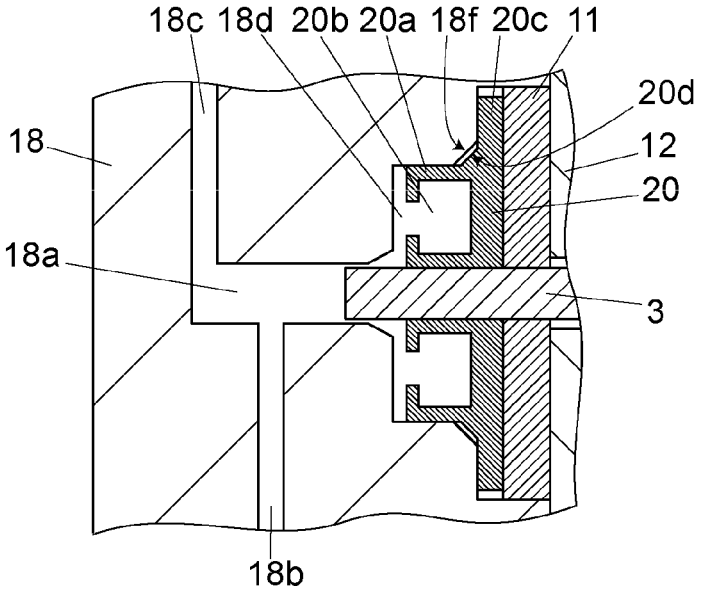
Fig. 2B Prior Art

Referring to FIGS. 1B and 1C, a portion where the plunger seal 10 is mounted will be described. The plunger seal 10 is made of an elastic material such as a polyethylene resin. The plunger seal 10 has a through hole 10*e* through which the plunger 3 passes and retains the plunger 3 for sliding. The plunger seal 10 has a cylindrical protruding portion 10*a* on its front face. A base end portion 10*d* of the protruding portion 10*a* has a sectional shape having a certain curvature. A base end side of the plunger seal 10 has a disc shape and forms the flange-shaped peripheral edge portion 10*c*.

The protruding portion 10*a* has an open groove 10*b* open on the pump chamber 8*a* side. The open groove 10*b* is formed in a ring shape continuous in a circumferential direction of the plunger 3. The open groove 10*b* is provided to store the solvent leaking from between an inner wall of the pump chamber 8*a* and the outer periphery of the plunger 3 and to utilize pressure increase in the pump chamber 8*a* to increase sealing performance.

In the portion of the pump head 8 where the plunger seal 10 is mounted, a seal insertion portion 8*d* into which the protruding portion 10*a* of the plunger seal 10 is to be fitted is formed as a cylindrical recessed portion. An opening edge portion 8*f* of the seal insertion portion 8*d* has a protruding curved sectional shape which is an arc shape and has the same curvature as the base end portion 10*d* of the protruding portion 10*a* of the plunger seal 10 as a preferable example of the sectional shape in this embodiment.

The plunger seal 10 is fixed with the protruding portion 10*a* fitted into the seal insertion portion 8*d* and the flange-shaped peripheral edge portion 10*c* sandwiched between a face 8*e* around the seal insertion portion 8*d* and the backup ring 11. At this time, an outer peripheral face of the protruding portion 10*a* of the plunger seal 10 comes in close contact with an inner peripheral face of the seal insertion portion 8*d* and the base end portion 10*d* of the protruding portion 10*a* has the same recessed curved shape as the opening edge portion 8*f* of the seal insertion portion 8*d* and has the arc shape having the same curvature as the opening edge portion 8*f* in the embodiment and, therefore, the base end portion 10*d* comes in close contact with the opening edge portion 8*f*, and a front face of the peripheral edge portion 10*c* comes in close contact with the face 8*e* around the seal insertion portion 8*d*. Because the opening edge portion 8*f* of the seal insertion portion 8*d* and the base end portion 10*d* of the protruding portion 10*a* have the shapes with the same curvatures without edges, stress applied by the backup ring 11 on the plunger seal 10 is not concentrated on a particular portion of the surface of the plunger seal 10, and it is possible to suppress progress of deterioration of the plunger seal 10.

Figure 3A:
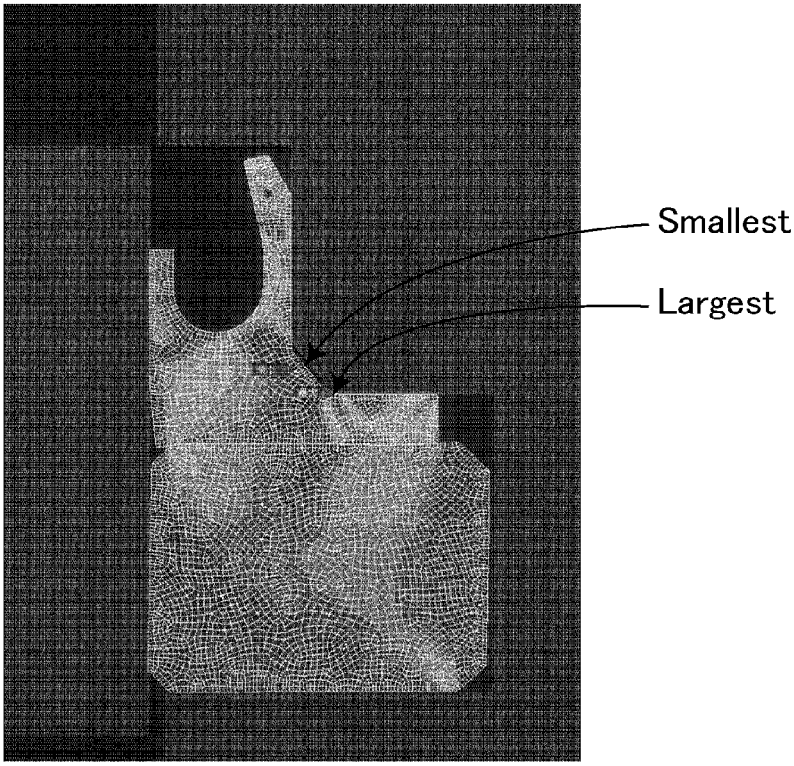
Fig. 3A Prior Art
Figure 3B:
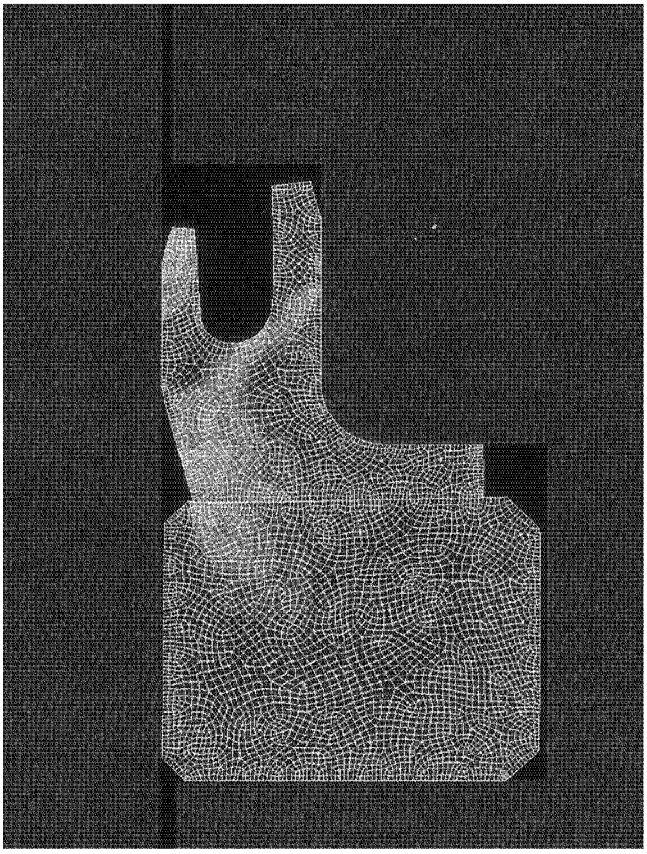

FIGS. 3A and 3B are drawings showing results of simulations of stress distribution in sections of the plunger seals, wherein FIG. 3A shows the result in the conventional structure, and FIG. 3B shows the result in the structure in the embodiment.

The results of the simulations show that, in the conventional structure in FIG. 3(A), the stress applied on portions, out of the face of the plunger seal in contact with the wall face of the pump head, in contact with edges of the tapered shape is the largest and that the stress applied on a portion between the two portions in contact with the edges of the tapered shape is the smallest. This concentration of the stress causes local deformation of the plunger seal to affect life of the plunger seal. On the other hand, in the structure of the embodiment in FIG. 3(B), the stress is applied substantially uniformly on the entire face of the plunger seal in contact with the wall face of the pump head and is not concentrated on a particular portion, the local deformation as shown in FIG. 3(A) is not caused, and life of the plunger seal can be extended.

The invention claimed is:

1. A solvent delivery pump comprising:

a pump body;

a pump head mounted to a tip end portion of the pump body including a solvent inlet for suctioning a solvent, a pump chamber for storing the solvent suctioned from the solvent inlet, and a solvent outlet for discharging the solvent in the pump chamber;

a plunger passing through the tip end portion of the pump body having a tip end inserted into the pump chamber to slide in the pump chamber;

a seal insertion portion formed in a face of the pump head on the pump body side as a cylindrical recessed portion having a larger inner diameter than an outside shape of the plunger and communicating with the pump chamber;

a ring-shaped plunger seal having, on its face on the pump head side, a cylindrical protruding portion to be fitted into the seal insertion portion retaining the plunger for sliding between the pump body and the pump head to thereby seal a portion of the pump chamber where the plunger is inserted, and the plunger seal having a peripheral edge portion with a front face that comes in contact with a face around the seal insertion portion; and a member immovably fixed on the pump body side of the plunger seal for fixing the plunger seal by sandwiching the peripheral edge portion of the plunger seal between the face around the seal insertion portion and the member, wherein an opening edge portion of the seal insertion portion of the pump head has a section having a protruding curved shape, a base end portion of the protruding portion of the plunger seal has a section having a recessed curved shape corresponding to the opening edge portion of the seal insertion portion, and wherein the base end portion of the protruding portion is sandwiched between the opening edge portion and the member so that the opening edge portion and the base end portion of the protruding portion are in contact with each other with a stress applied constantly from the member.

2. A solvent delivery pump according to claim 1, wherein both the curved shapes are arc shapes having the same curvatures.

3. A solvent delivery pump according to claim 1, wherein both the curved shapes are arc shapes having the same curvatures without edges.

4. A solvent delivery pump according to claim 1, wherein the plunger seal has a protruding portion in the pump chamber side, said protruding portion having an open groove that is open on the pump chamber side.

* * * * *